US007982123B2

(12) United States Patent
Mulvany

(10) Patent No.: US 7,982,123 B2
(45) Date of Patent: Jul. 19, 2011

(54) PASSIVE ELECTROMAGNETIC STRING ISOLATING PICKUP

(76) Inventor: Collin Mulvany, North Bend, WA (US)

( * ) Notice: Subject to any disclaimer, the term of this patent is extended or adjusted under 35 U.S.C. 154(b) by 30 days.

(21) Appl. No.: 12/421,033

(22) Filed: Apr. 9, 2009

(65) Prior Publication Data

US 2009/0255397 A1 Oct. 15, 2009

Related U.S. Application Data

(60) Provisional application No. 61/071,135, filed on Apr. 10, 2008.

(51) Int. Cl.
*G10H 3/18* (2006.01)

(52) U.S. Cl. ..... 84/726; 84/725

(58) Field of Classification Search ..... 84/725–728
See application file for complete search history.

(56) References Cited

U.S. PATENT DOCUMENTS 2,896,491 A * 7/1959 Lover ..... 84/725
2,964,985 A * 12/1960 Webster ..... 84/723
2,976,755 A * 3/1961 Fender ..... 84/727
3,249,677 A * 5/1966 Burns et al. ..... 84/726
3,483,303 A * 12/1969 Warner ..... 84/728
3,983,778 A * 10/1976 Bartolini ..... 84/726
4,096,780 A * 6/1978 Dawson ..... 84/726
4,164,163 A * 8/1979 Rhodes ..... 84/728
4,269,103 A * 5/1981 Underwood ..... 84/726
4,372,187 A * 2/1983 Berg ..... 84/722
4,408,513 A * 10/1983 Clevinger ..... 84/726
4,534,258 A * 8/1985 Anderson ..... 84/728
4,535,668 A * 8/1985 Schaller ..... 84/727
4,878,412 A * 11/1989 Resnick ..... 84/726
5,335,576 A * 8/1994 Hayashi ..... 84/727
5,336,845 A * 8/1994 Lace, Sr. ..... 84/726
5,389,731 A * 2/1995 Lace ..... 84/726
5,430,246 A * 7/1995 Lace et al. ..... 84/726
5,508,474 A * 4/1996 Tumura ..... 84/726
5,530,199 A * 6/1996 Blucher ..... 84/728
5,585,588 A * 12/1996 Tumura ..... 84/726
5,591,931 A * 1/1997 Dame ..... 84/726
5,723,805 A * 3/1998 Lacombe ..... 84/727
5,767,431 A * 6/1998 Khanagov ..... 84/726
5,831,196 A * 11/1998 Khanagov ..... 84/726

(Continued)

FOREIGN PATENT DOCUMENTS

JP 11-045091 A 2/1999

(Continued)

OTHER PUBLICATIONS

ISR and Written Opinion, PCT/US2009/040055, mailed Nov. 11, 2009.

*Primary Examiner* — David S. Warren
(74) *Attorney, Agent, or Firm* — Merchant & Gould

(57) ABSTRACT

A passive pickup that utilizes electromagnetic coils comprising circuits that are connected in series and placed underneath and parallel to the strings of the electrical instrument. Each circuit within the passive pickup can be run through separate amplifiers in stereo or combined with standard guitar pickup signals and run through one or more amplifiers. The passive string isolating pickup is directed at allowing utilization of signal processing (guitar effects) in a string-isolated mono or stereo manner and the adjustment the volume and tone of isolated strings when wired in conjunction with volume and tone potentiometers.

20 Claims, 7 Drawing Sheets three and three string isolation two circuits in stereo configuration four and two string isolation two circuits in stereo configuration

U.S. PATENT DOCUMENTS

| | | | | |
|---|---|---|---|---|
| 5,932,827 | A * | 8/1999 | Osborne et al. | 84/726 |
| 6,111,185 | A * | 8/2000 | Lace | 84/726 |
| 6,121,537 | A * | 9/2000 | Pawar et al. | 84/728 |
| 6,211,671 | B1 * | 4/2001 | Shattil | 324/225 |
| 6,372,976 | B2 * | 4/2002 | Damm | 84/723 |
| 6,476,309 | B2 * | 11/2002 | Gaglio | 84/726 |
| 6,846,981 | B2 * | 1/2005 | Devers | 84/728 |
| 6,992,243 | B2 * | 1/2006 | Small | 84/267 |
| 7,208,673 | B2 * | 4/2007 | Bryce | 84/742 |
| 7,244,886 | B2 * | 7/2007 | Hosler | 84/726 |
| 7,514,626 | B1 * | 4/2009 | Snyder | 84/733 |
| 7,612,282 | B1 * | 11/2009 | Lawing | 84/726 |
| 7,667,131 | B2 * | 2/2010 | Ierymenko | 84/735 |
| 7,718,886 | B1 * | 5/2010 | Lace | 84/727 |
| 2002/0020281 | A1 * | 2/2002 | Devers | 84/728 |
| 2002/0073829 | A1 * | 6/2002 | Gaglio | 84/726 |
| 2002/0073830 | A1 * | 6/2002 | Petherick | 84/726 |
| 2005/0028669 | A1 * | 2/2005 | Kavanaugh | 84/726 |
| 2005/0126376 | A1 * | 6/2005 | Hosler | 84/726 |
| 2005/0126377 | A1 | 6/2005 | Kanayama et al. | 84/726 |
| 2005/0150364 | A1 * | 7/2005 | Krozack et al. | 84/726 |
| 2006/0156912 | A1 | 7/2006 | Annis et al. | 84/742 |
| 2008/0245218 | A1 * | 10/2008 | Stewart | 84/727 |
| 2009/0255397 | A1 * | 10/2009 | Mulvany | 84/726 |
| 2010/0005954 | A1 * | 1/2010 | Higashidate et al. | 84/725 |
| 2010/0101399 | A1 * | 4/2010 | Calvet | 84/726 |
| 2010/0122623 | A1 * | 5/2010 | Salo | 84/726 |

FOREIGN PATENT DOCUMENTS

KR 10-2005-0053262 A 6/2005

* cited by examiner

PASSIVE ELECTROMAGNETIC STRING ISOLATING PICKUP

CROSS-REFERENCE TO RELATED APPLICATIONS

This application claims the benefit under 35 U.S.C. §119 (e) of U.S. Provisional Application No. 61/071,135, filed on Apr. 10, 2008.

FIELD OF THE INVENTION

The present invention relates generally to pickups for stringed musical instruments. In particular, the present invention relates to a passive electromagnetic pickup for an electronic instrument.

BACKGROUND OF THE INVENTION

Many stringed musical instruments, such as guitars, include one or more pickups to capture the vibrations of the strings. Typically, the metal strings of a guitar are positioned above and perpendicular to the pickup such that when the strings vibrate the pickup detects the vibration and creates a signal. The pickup is usually mounted on the body of the electronic instrument, but can also be attached at other locations on the instrument. An electromagnetic pickup generally consists of one or more magnets that is wrapped with thousands of rotations of copper coil wire. When the instrument is played, and one or more of the strings vibrate, the magnetic flux linking the coil induces an alternating current through the coil. This signal can then be supplied to amplification and/or recording equipment. Different types of pickups exist for electronic instruments. For example, a single coil pickup and a humbucking pickup are common types of pickups for guitars. Each type of pickup has its own type of sound as well as having different tendencies. For instance, single coil pickups have a tendency to also pick up ambient hum along with the vibration of the strings. This hum could come from many sources, such as alternating current frequency, power-supplies, radio frequencies and other electronic devices. A humbucking pickup, on the other hand, usually includes two pickups that are wired together with identical coils having fields of opposite magnetic polarity and phase. In this arrangement, the ambient hum reaches the coils as common-mode noise, inducing an electrical current of equal magnitude in each coil, thereby eliminating the hum.

SUMMARY OF THE INVENTION

The present invention is directed to an apparatus and method for isolating one or more strings in an electronic instrument using a passive pickup. Briefly stated, the passive pickup utilizes circuits comprising coils that are connected in series and placed underneath and parallel to the strings of the electrical instrument. Each circuit within the passive pickup can be run through separate amplifiers in stereo or combined with standard guitar pickup signals and run through one or more amplifiers. The passive string isolating pickup is directed at allowing utilization of signal processing (guitar effects) in a string-isolated mono or stereo manner and the adjustment the volume and tone of isolated strings when wired in conjunction with volume and tone potentiometers.

A more complete appreciation of the present invention and its improvements can be obtained by reference to the accompanying drawings, which are embodiments of the invention briefly summarized below, to the following detail description of presently preferred, and to the appended claims.

DETAILED DESCRIPTION OF THE PREFERRED EMBODIMENT

Throughout the specification, and in the claims, the term "connected" means a direct electrical connection between the things that are connected, without any intermediary devices. The term "coupled" means either a direct electrical connection between the things that are that is connected, or an indirect connection through one or more passive or active intermediary devices. The term "circuit" means one or more passive and/or active components that are arranged to cooperate with one another to provide a desired function. The term "signal" means at least one current signal, voltage signal or data signal.

The present invention relates to a passive pickup for a stringed electronic instrument. Briefly stated, the passive pickup utilizes circuits comprising coils that are connected in series and placed underneath and parallel to the metal strings of the electrical instrument. Each circuit within the passive pickup can be run through separate amplifiers in stereo or combined with standard guitar pickup signals and run through one or more amplifiers. The passive string isolating pickup is directed at allowing utilization of signal processing (guitar effects) in a string-isolated mono or stereo manner and the adjustment the volume and tone of isolated strings when wired in conjunction with volume and tone potentiometers.

Figure 1:
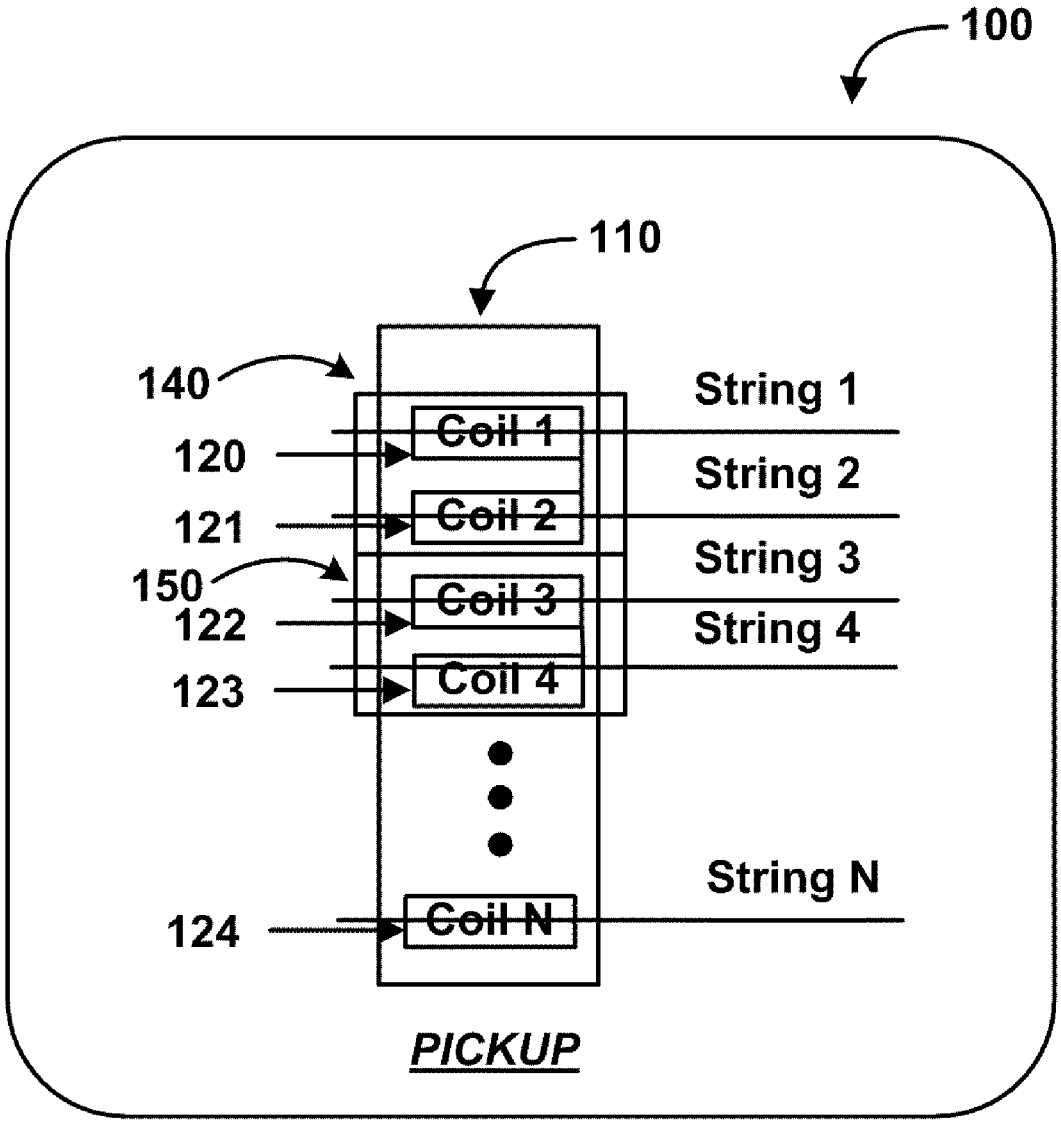
FIG. 1 shows an overview of a passive string isolating pickup for an electronic instrument.

FIG. 1 shows an overview of a passive string isolating pickup for an electronic instrument, according to embodiments of the invention. As illustrated, electronic instrument 100 is a stringed instrument having N strings. For example, the instrument could be an electronic guitar having six metal strings, an electronic guitar having 12 metal strings, an electronic bass having 4 metal strings, and the like. Instrument 100 includes a pickup 110 having N coils (120-124) that are disposed underneath the strings and run parallel to the strings.

Pickup 110 is a passive pickup that is directed at creating one or more string-isolating signals for instrument 100. The coils within the pickup are configured such that at least two of the coils are connected in series forming a circuit. Many different circuits may be configured within pickup 110. For example, pickup 110 may be configured as a 2-2-2 string isolating pickup (see FIG. 2), a 3-3 string isolating pickup (see FIG. 3), a 2-4 string isolating pickup (see FIG. 4), and the like. According to one embodiment, each circuit, such as circuit 140, comprises at least two coils connected in series within the passive pickup. The outputs of each circuit can be run through separate amplifiers in stereo or combined with standard guitar pickup signals and run through one or more amplifiers. For example, coil 1 and coil 2 may be connected in series to form a first circuit 140 having an output (not shown) and coils 3-4 can be connected in series to form a second circuit 150 having a second output (not shown).

According to one embodiment, each coil has two magnetic polepieces that are mounted parallel to each string. According to other embodiments, each coil may include one or more magnetic polepieces. According to other embodiments, each coil may include one or more bar magnets. The location of pickup 110 on the instrument may be used in determining the spacing of the coils. For example, a pickup that is located near the bridge of the instrument typically has a different spacing for the coils then the spacing of the coils when the pickup is located nearer the neck of the instrument. There are several standards on pickup sizes and string spacing between the poles that may be consulted in determining the correct spacing for the instrument.

Each coil comprises thousands of rotations of copper coil wire wound on a bobbin consisting of flatwork and two magnetic poles running parallel to each metal string of an electric instrument. For example, according to one embodiment, when the electronic instrument is a six string guitar then six coils are mounted parallel to each string on a base plate, wax potted and covered with a standard size "humbucker" pickup cover. Other pickup covers may also be utilized. A standard "humbucker" guitar pickup cover is commercially available and is typically a plastic, wood or metal rectangular cover within tolerance of an averaged string spacing of 0.4067" (6 strings). This average reflects a range of common positioning of pickups on the body of a guitar and thus common string spacing: as the spacing diminishes or augments based upon location.

The mounting plate and cover allow the passive pickup to fall within the size restrictions of most electric guitar mounting dimensions. As single coils, with poles magnetized in a north and north or south and south (non-opposing orientation) and run parallel to each string, each coil isolates its' respective string. When each coil is run in series and properly balanced relative to each circuit's respective resistance, the device creates a range of standard passive output. This is a result of the amount of resistance combined with the principal of "constructive interference." Balancing of the circuits may be achieved by varying the number of wraps of each coil. For example, in a 2-2-2 configuration each coil may be wrapped with approximately the same number of wraps (See FIG. 4 and related discussion), whereas in a 2-4 configuration each coil within the 4 coil circuit typically comprises approximately half of the number of wraps of the coils in the 2 coil circuit (See FIG. 4 and related discussion).

More wraps may be used to create greater output depending on the technology of the winding device. For example, the coil may be wrapped manually with a rudimentary guitar pickup winder which is commonly referred to as "scatter wound". Laser guided coiling technology can achieve a greater amount wraps. Wider spacing between strings can also allow for more wraps.

The range of resistance for most single coil pickups is 5 to 7 kΩ. It is common to have several guitar pickups in a single instrument with different levels of resistance per pickups have coils that are mounted perpendicular to the string of an instrument instead of coils that are mounted parallel to the strings as described with regard to pickup 110. Pickup 110 allows for string isolation and circuit balance in one pickup, while still within a functional range of standard output for a standard single coil pickup and within tolerance of standard "humbucker" pickup cover size limitations. FIGS. 2-6 show exemplary embodiments of a passive pickup.

Figure 2:
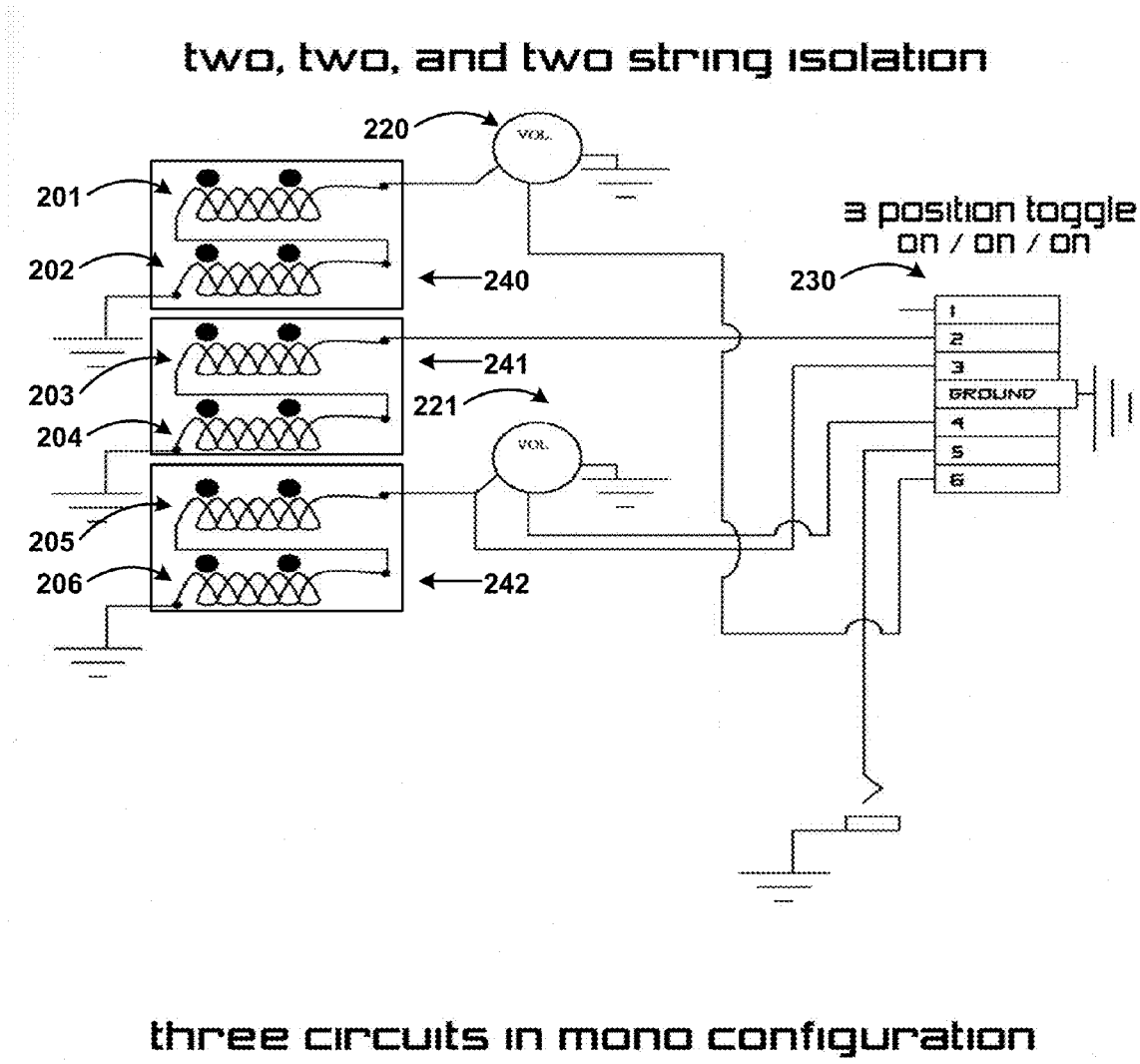
FIG. 2 illustrates a 2-2-2 string isolating passive pickup for an electronic instrument.

FIG. 2 illustrates a 2-2-2 string isolating passive pickup for an electronic instrument. As illustrated, 2-2-2 pickup includes coils 201-206, volume controls 220 and 221, and switch 230. Circuit 240 comprises coil 201 connected in series with coil 202. Circuit 241 comprises coil 203 connected in series with coil 204. Circuit 242 comprises coil 205 connected in series with coil 206. Output of circuit 240 is coupled to volume control 220. Volume control 220 is coupled to position 6 on switch 230. Output of circuit 241 is coupled to position 2 on switch 230. Output of circuit 3 is coupled to volume control 221. Volume control 221 is coupled to positions 3 and 4 on switch 230.

According to one embodiment, pickup 2-2-2 is configured as a guitar pickup that runs two coils in series (for a total of three circuits) thereby isolating two strings on an electronic instrument at a time. Each coil within the 2-2-2 pickup configuration is parallel to and located beneath one of the strings of the instrument. When connected to toggle switch 230, as many as four or as few as two strings may be isolated. According to one embodiment, each coil (201-206) is wrapped with approximately 7000-7120 wraps of 42-gauge copper coil that is directed at yielding an approximate range of resistance between 2.5 kΩ per coil and 5.0 kΩ per circuit. According to other embodiments, the amount of wraps as well as the gauge of the copper wire can be varied to achieve the desired output and sound. Additionally, while the 2-2-2 pickup is illustrated for a six-stringed musical instrument, a similar design may be used for a four string instrument (i.e. a 2-2 pickup) that includes two pairs of coils instead of three pairs of coils. Similarly, a larger number of pairs of coils could be used for more strings. Generally, using this configuration each pair of strings in the musical instrument utilizes one pair of coils.

Figure 3:
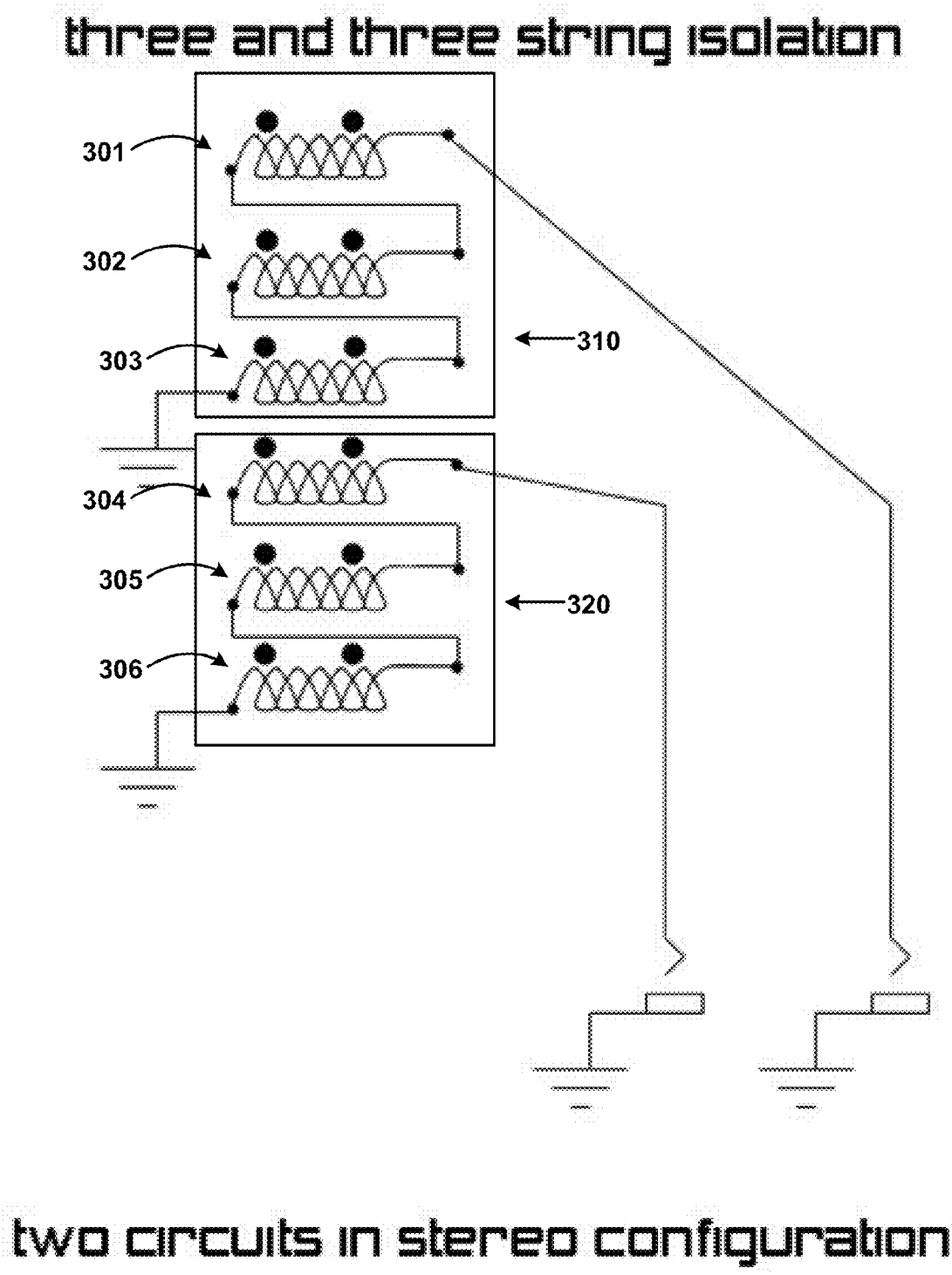
FIG. 3 shows a 3-3 string isolating passive pickup for an electronic instrument.

FIG. 3 shows a 3-3 string isolating passive pickup for an electronic instrument. As illustrated, 3-3 pickup includes coils 301-306. Circuit 310 comprises coil 301 connected in series with coils 302 and 303. Circuit 320 comprises coil 304 connected in series with coils 305 and 306. Pickup 3-3 is a pickup that runs three coils in one circuit for a total of two circuits. According to one embodiment, pickup 3-3 is a guitar pickup that is configured to isolate as few as three strings. According to one embodiment, each coil is wrapped with approximately 5900-6020 wraps of 42-gauge copper coil wire per coil that is directed at yielding an approximate range of resistance of 6.24-6.34 kΩ per circuit. Similarly to the pickup discussed in FIG. 2, the amount of wraps as well as the copper gauge can be adjusted according to other embodiments in order to achieve the desired sound and output. Further, the design of the 3-3 pickup can be modified to a different number of strings. For example, the 3-3 pickup could be modified to a twelve string instrument.

Figure 4:
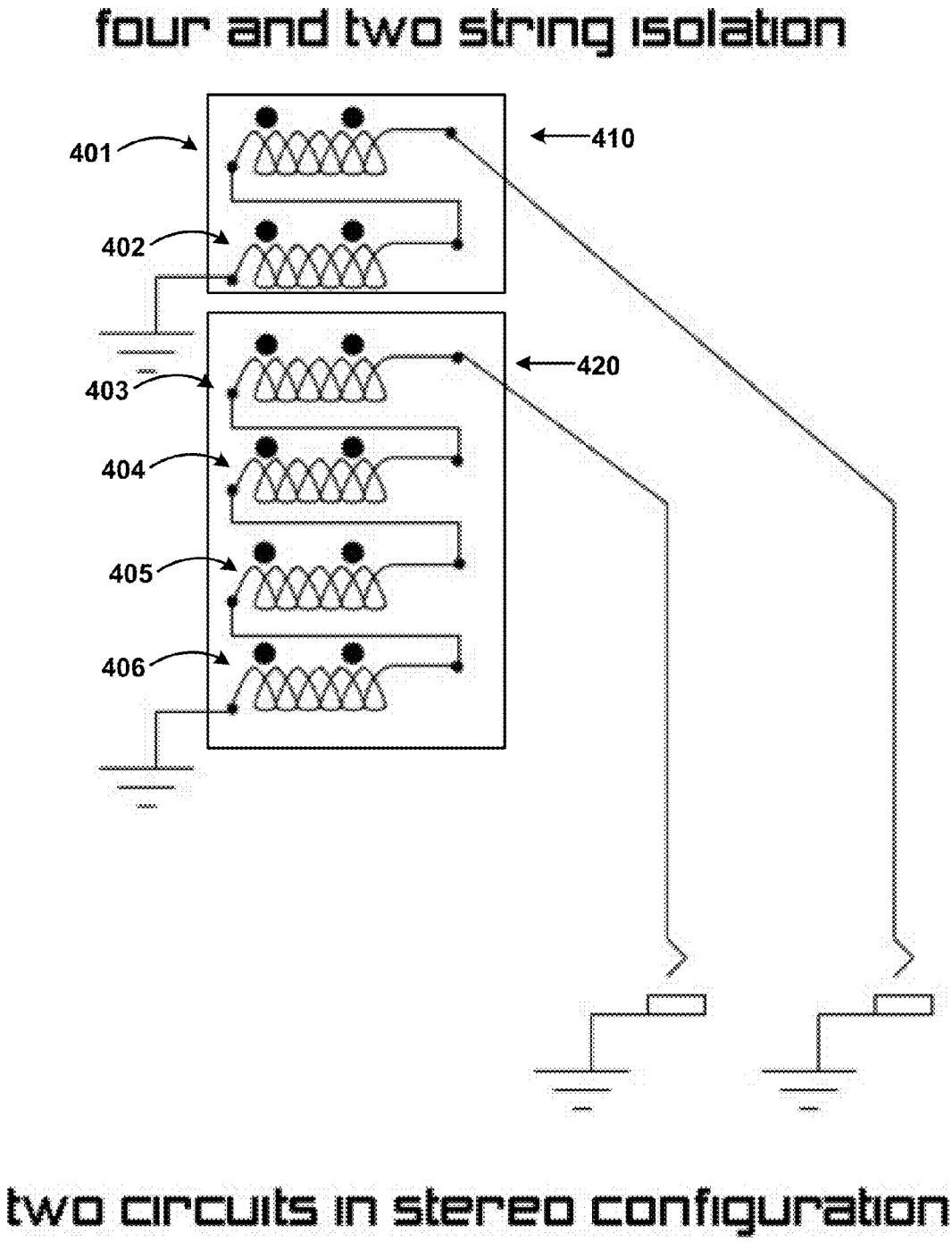
FIG. 4 illustrates a 4-2 string isolating passive pickup for an electronic instrument.

FIG. 4 illustrates a 4-2 string isolating passive pickup for an electronic instrument. As illustrated, 4-2 pickup includes coils 401-406. Circuit 410 comprises coil 401 connected in series with coil 402. Circuit 420 comprises coil 403 connected in series with coils 404, 405 and 406.

The 4-2 pickup is configured as a pickup that has a first circuit 410 that runs two coils in series and a second circuit 420 that runs four coils in series for a total of two circuits. According to one embodiment, each coil within the first circuit 410 is wrapped with approximately 7000-7120 wraps of 42 gauge copper coil wire per coil that is directed at achieving an approximate resistance ranging from approximately 5.0 to 5.1 kΩ and each coil in the second circuit 420 is wrapped with approximately 3600-3720 wraps of 42 gauge copper coil wire per coil directed at producing a resistance ranging from approximately 5.0 to 5.1 kΩ. As can be seen, the number of wraps in each coil in the second circuit 420 is approximately half the number of wraps in each coil of the first circuit 410. Generally, the number of wraps for each coil in the second circuit 420 is configured such that the resistance of the second circuit is approximately the same resistance as the first circuit 410.

Figure 5:
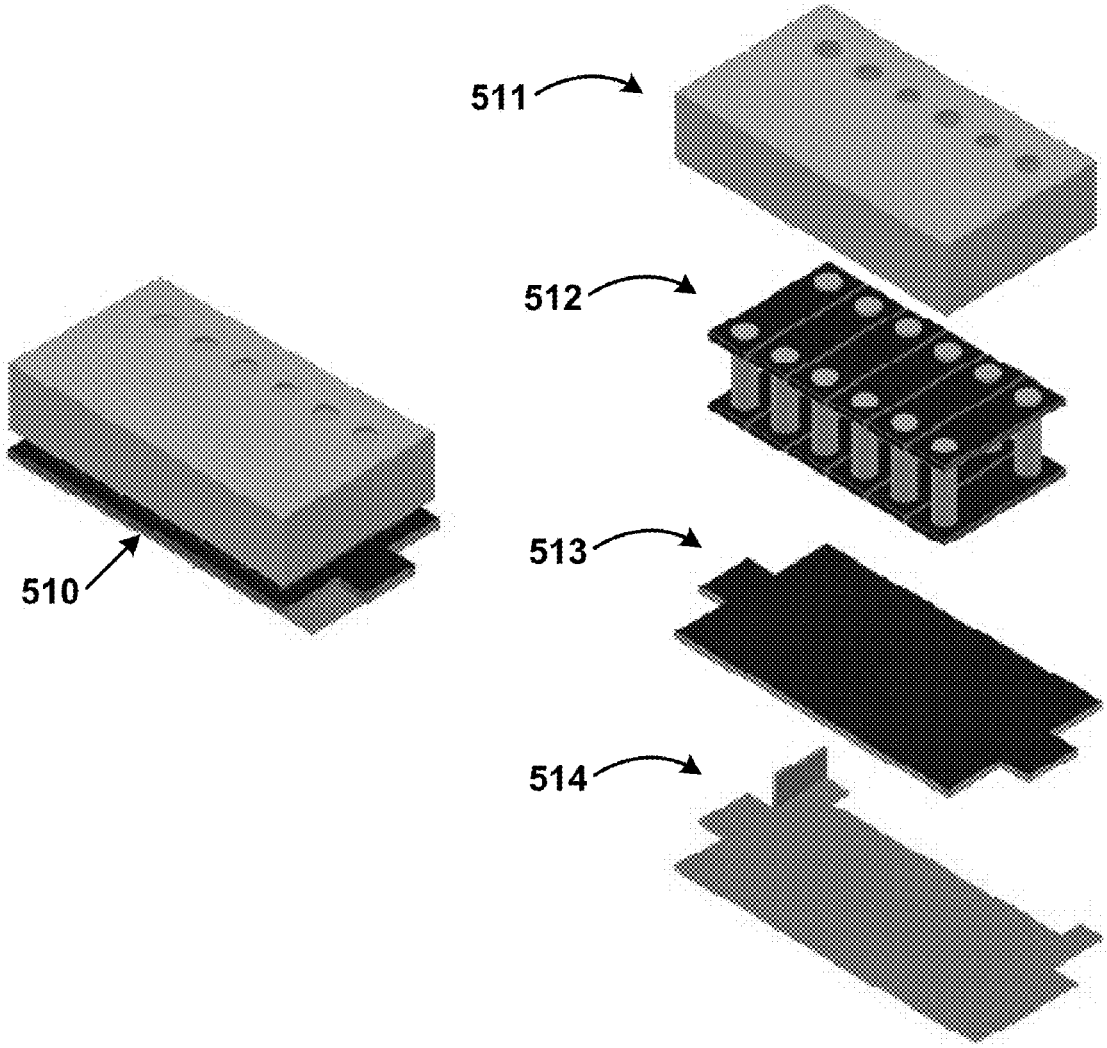
FIG. 5 shows an assembled passive pickup with an exploded view of the string isolating passive pickup.

FIG. 5 illustrates a schematic of an exemplary packaging for a passive pickup configured according to embodiments of the invention.

As illustrated, assembled passive pickup 510 comprises a standard cover 511, bobbin 512, top base place 513 and bottom base plate 514. According to one embodiment, the passive pickup is designed for a six string electrical guitar. According an embodiment, the passive pickups described herein are designed to be consistent with standard guitar pickup manufacturing and the materials used in the manufacturing of the passive pickup are commercially available.

Figure 6:
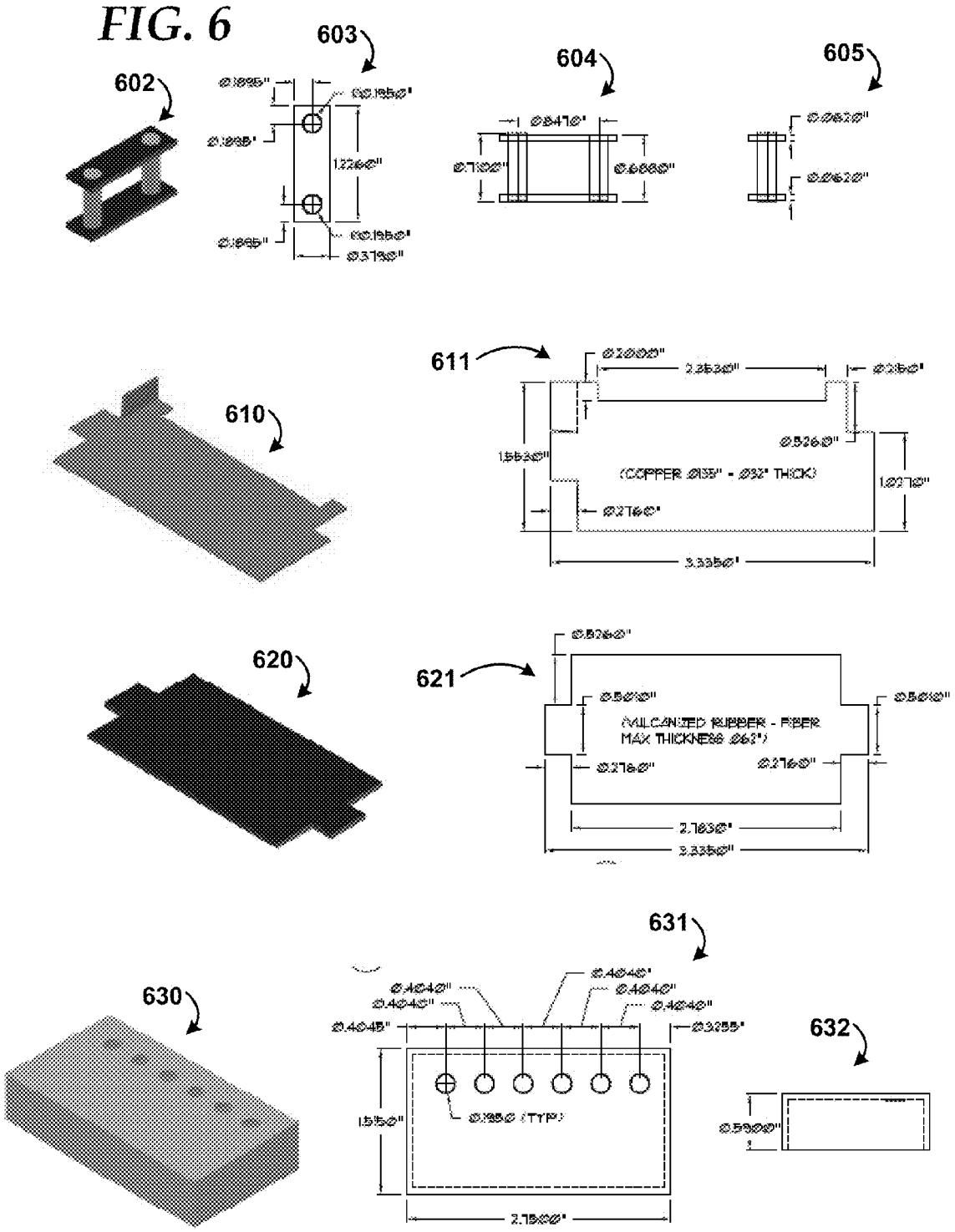
FIG. 6 shows Isometric views of exemplary components of a passive pickup.

FIG. 6 shows Isometric views of exemplary components of a passive pickup, according to embodiments of the invention.

As shown, a top view 603, a front view 604, and a side view 605 is illustrated for bobbin assembly 602. A top view is illustrated for bottom base plate 610. According to one embodiment, bottom base plate 610 is made from copper that is approximately 0.0135-0.032 inches thick. A top view 621 is illustrated from top of base plate 620. According to one embodiment, the top of the base plate 620 is made from vulcanized rubber having a thickness generally not exceeding 0.062 inches. A side view 632 and a top view 631 is illustrated from cover 630. According to one embodiment, the cover is a standard "humbucker" cover. While a standard humbucker cover is illustrated, the passive pickup may be designed to fit within other standard and/or non-standard covers. Additionally, while the eyelets for wire and circuit connection, the copper coil wire, the wax that surrounds the internal structure, the wires that connect the device to the guitar, and the mounting-screws are not illustrated, guitar pickups have been assembled, connected and mounted in this manner since the 1950's. As mentioned above, according to embodiments of the invention, the passive pickup falls within functional tolerance of all the aforementioned materials.

Figure 7:
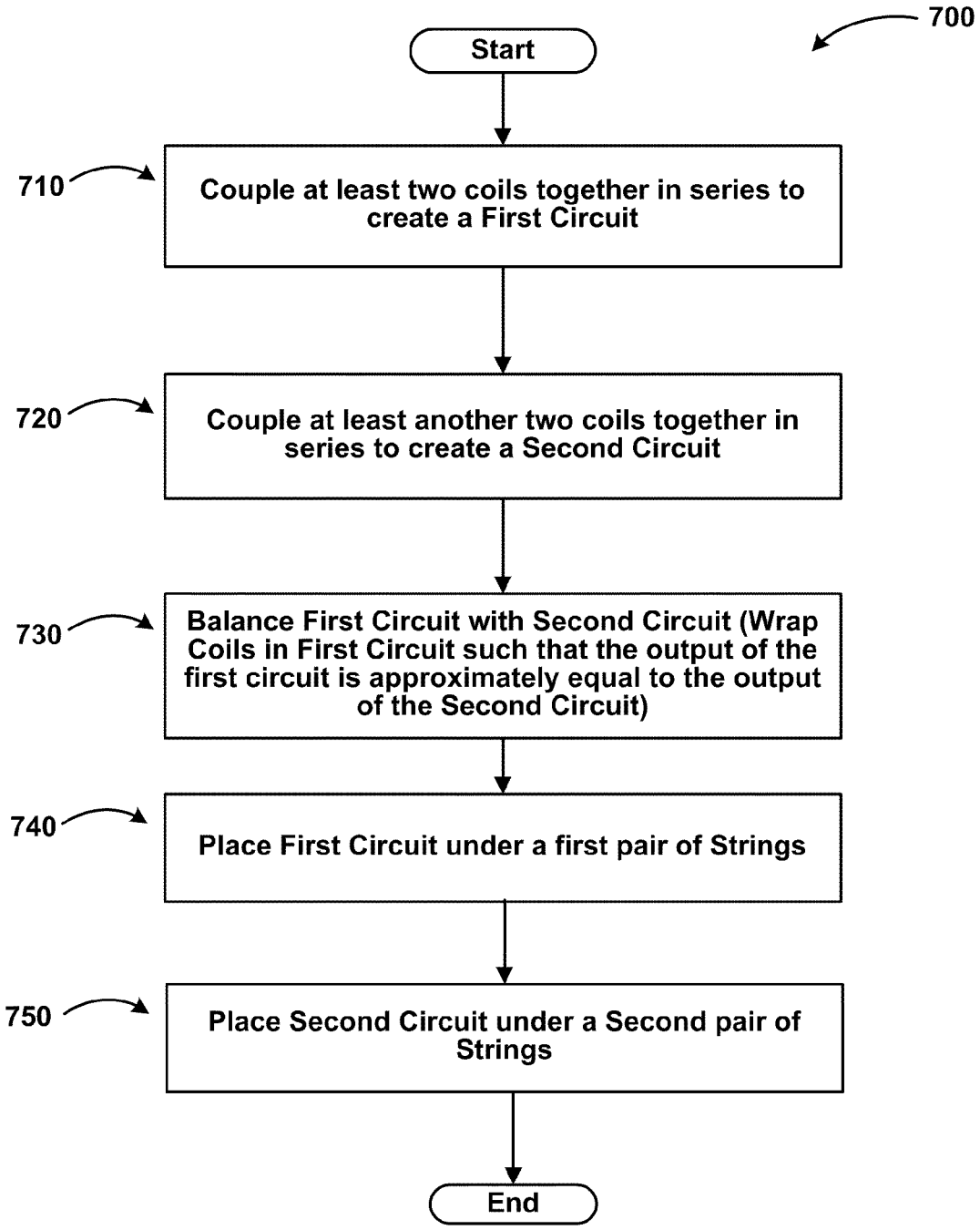
FIG. 7 illustrates a method for configuring a string isolating passive pickup, in accordance with embodiments of the invention.

FIG. 7 illustrates a method 700 for configuring a string isolating passive pickup, in accordance with embodiments of the invention.

After a start operation, the process flows to operation 710 where at least two coils are connected in series to form a first circuit. Generally, each coil that is connected in series isolates a string. Therefore, when two coils are connected in series, the circuit isolates two strings, when three coils are connected in series; the circuit isolates three strings, and the like.

Moving to operation 720, another two coils are connected in series to form a second circuit. As discussed above, each circuit may isolate a same number of strings or a different number of strings.

Flowing to operation 730, the first circuit is balanced with the second circuit such that the output of the first circuit is approximately equal to the output of the second circuit. According to one embodiment, the first circuit is balanced with the second circuit by determining a number of wraps for each coil within the first and second circuits. For example, when the number of coils within the first circuit is equal to the number of coils within the second circuit then the number of wraps for each coil is approximately equal. When the number of coils within either the first or second circuit is different, then the number of wraps for each coil may change. For example, in a first circuit having two coils and a second circuit having four coils, then the number of wraps for each coil in the second circuit is approximately half the number of wraps as compared to each coil in the first circuit.

Moving to operations 740 and 750, the circuits are placed under strings of the electrical instrument. Generally, each coil is placed beneath a single string and the coil runs parallel to that string.

The process then moves to an end operation.

The above specification, examples and data provide a complete description of the manufacture and use of the composition of the invention. Since many embodiments of the invention can be made without departing from the spirit and scope of the invention, the invention resides in the claims hereinafter appended.

I claim:

1. An apparatus for a passive electromagnetic pickup for an electronic instrument having metal strings, the apparatus comprising:

a first circuit comprising a first coil arranged in series with a second coil; wherein the first circuit is configured to isolate at least two strings of the electronic instrument; and a second circuit comprising a third coil arranged in series with a fourth coil; wherein the second circuit is configured to isolate at least two other strings of the electronic instrument, wherein each of the coils of the first circuit and the second circuit comprise thousands of wraps of wire wound on a bobbin, wherein the bobbins of the first circuit and the bobbins of the second circuit comprise a different number of wraps, wherein a number of wraps for each bobbin of the first circuit is determined from a number of coils that are included within each circuit of the apparatus, wherein a number of wraps for each bobbin of the second circuit is determined from the number of coils that are included within each circuit of the apparatus.

2. The apparatus as in claim 1, further comprising a third circuit comprising a fifth coil arranged in series with a sixth coil; wherein the third circuit is configured to isolate at least two other strings of the electronic instrument.

3. The apparatus as in claim 1, wherein the second circuit further comprises a fifth coil and a sixth coil that is arranged in series with the third coil and the fourth coil; wherein the second circuit is configured to isolate at least four other strings of the electronic instrument.

4. The apparatus as in claim 1, wherein the first circuit further comprises a fifth coil that is arranged in series with the first coil and the second coil.

5. The apparatus as in claim 4, wherein the second circuit further comprises a sixth coil that is arranged in series with the third coil and the fourth coil.

6. The apparatus as in claim 1, wherein the first coil, the second coil, the third coil and the fourth coil include an approximately equal number of wraps.

7. The apparatus as in claim 2, wherein the first coil and the second coil have approximately a double number of wraps as compared to a number of wraps for each of the third coil, the fourth coil, the fifth coil and the sixth coil.

8. The apparatus as in claim 1, wherein the first circuit and the second circuit are located within a standard guitar pickup cover.

9. The apparatus as in claim 1, wherein each of the coils are located under and parallel to one of the strings of the electronic instrument.

10. An apparatus for an electromagnetic passive pickup for an electronic instrument having metal strings, the apparatus comprising:

a first circuit comprising coils that are configured to isolate a first set of strings of the electronic instrument; wherein the coils are positioned parallel and underneath the first set of strings; and a second circuit comprising coils that are configured to isolate a second set of strings of the electronic instrument; wherein the second coils are positioned parallel and underneath the second set of strings, wherein each of the coils of the first circuit and the second circuit comprise thousands of wraps of wire wound on a bobbin, wherein the bobbins of the first circuit and the bobbins of the second circuit comprise a different number of wraps, wherein a number of wraps for each bobbin of the first circuit is determined from a number of coils of the first circuit and a number of coils of the second circuit, wherein a number of wraps for each bobbin of the second circuit is determined from the number of coils of the second circuit and the number of coils of the first circuit.

11. The apparatus as in claim 10, wherein the first circuit further comprises a third coil arranged in series with the first coil; wherein the third coil is positioned parallel and underneath to another string.

12. The apparatus as in claim 11, wherein the second circuit further comprises a fourth coil arranged in series with the second coil; wherein the fourth coil is positioned parallel and underneath to yet another string.

13. The apparatus as in claim 12, wherein the first circuit further comprises a fifth coil that is arranged in series with the first coil and the third coil.

14. The apparatus as in claim 13, wherein the second circuit further comprises a sixth coil that is arranged in series with the second coil and the fourth coil.

15. The apparatus as in claim 10, wherein an output of the first circuit is balanced with an output of the second circuit by adjusting a number of wraps of each coil within the first circuit and the second circuit.

16. The apparatus as in claim 10, wherein the first circuit and the second circuit are located within a standard guitar pickup cover.

17. A method for isolating strings of an electronic musical instrument having strings, comprising:

creating a first circuit by connecting at least two coils in series;

creating a second circuit by connecting at least two coils in series, wherein each of the coils of the first circuit and the second circuit comprise thousands of wraps of wire wound on a bobbin, wherein the bobbins of the first circuit and the bobbins of the second circuit comprise a different number of wraps, wherein a number of wraps for each bobbin of the first circuit is determined from a number of coils of the first circuit and a number of coils of the second circuit, wherein a number of wraps for each bobbin of the second circuit is determined from the number of coils of the second circuit and the number of coils of the first circuit; and placing each of the coils such that each coil runs parallel and is located beneath a string of the instrument.

18. The method of claim 17, further comprising balancing an output of the first circuit with an output of the second circuit.

19. The method of claim 18, wherein balancing the output comprises adjusting a number of wraps of each coil within the first circuit and the second circuit.

20. The method of claim 19, further comprising locating the first circuit and the second circuit within a standard pickup cover.

* * * * *